US007530883B2

(12) United States Patent
Yen

(10) Patent No.: US 7,530,883 B2
(45) Date of Patent: May 12, 2009

(54) FIXTURE FOR GRINDING MACHINES

(75) Inventor: Shih-Chieh Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/005,829

(22) Filed: Dec. 28, 2007

(65) Prior Publication Data

US 2008/0108287 A1 May 8, 2008

Related U.S. Application Data

(63) Continuation of application No. 11/309,619, filed on Sep. 1, 2006, now Pat. No. 7,371,157.

(30) Foreign Application Priority Data

Jan. 11, 2006 (CN) ..... 2006 1 0032943

(51) Int. Cl.
*B24B 41/06* (2006.01)

(52) U.S. Cl. ..... 451/11; 451/364; 451/58

(58) Field of Classification Search ..... 451/364, 451/365, 384, 390, 49, 28, 57, 58, 42, 43, 451/44, 51, 278, 279, 41, 232, 11–12
See application file for complete search history.

(56) References Cited

U.S. PATENT DOCUMENTS 744,559 A * 11/1903 Kendrick ..... 409/225

* cited by examiner

*Primary Examiner*—Robert Rose
(74) *Attorney, Agent, or Firm*—Steven M. Reiss

(57) ABSTRACT

A fixture for grinding machines includes a first base (10), a second base (20) and a driving component (40). The first base defines a first working groove (11) therein. The second base defines a second working groove (21) corresponding to the first working groove therein. The driving component is configured for sliding in the first working groove to remove workpieces from the first base, and sliding in the second working groove to cooperate with the second base to hold workpieces in the second working groove.

18 Claims, 8 Drawing Sheets

FIXTURE FOR GRINDING MACHINES

CROSS-REFERENCE TO RELATED APPLICATION

This application is a continuation application of U.S. Ser. No. 11/309,619, filed Sep. 1, 2006, now U.S. Pat. No. 7,371, 157, the contents of which are hereby incorporated by reference.

BACKGROUND OF THE INVENTION

1. Field of the Invention

The present invention generally relates to fixtures for grinding machines, and more particularly to a fixture for grinding machines which prevents ground workpieces from adhering to the fixture.

2. Description of Related Art

Many kinds of workpieces need to be ground to have a desired shape before use. For example, lenses used in digital camera modules are ground to be round to allow their installation into lens barrels. However, when grinding a plurality of workpieces at the same time, fixtures are used to properly secure the workpieces.

Referring to FIG. 8, a typical fixture for securing workpieces includes a first base 50 and a second base 60. The first base 50 is substantially cuboid, a first groove 51 is defined on a surface of the first base 50, and the first groove 51 has a triangular cross section. The second base 60 is also substantially cuboid, a second groove 61 is defined on a surface of the second base 60, and the second groove 61 has a semicircular cross section. A diameter of the semicircular cross section of the second groove 61 is equal to a diameter of ground workpieces.

When a whole piece of material such as glass (not shown) is cut to be a plurality of rectangular workpieces (not shown), then the workpieces are placed into the first groove 51 of the first base 50. Two adjacent sides of each workpiece are engaged with the first groove 51, thus each workpiece is aligned with all other workpieces and pressed close to other workpieces adjacent to itself. Afterwards, some ultraviolet (UV) glue is applied to the workpieces. The ultraviolet glue dries after being irradiated with ultraviolet radiation, thus all workpieces are secured in the first base 50 and form a quadrilateral prism. Two side faces of the quadrilateral prism are exposed from the first groove 51 and the other two face sides of the quadrilateral prism are engaged with the first groove 51. In this way, the ultraviolet glue prevents the workpieces from moving when the workpieces are being ground. A grinding wheel (not shown) is used to grind the two side faces exposed through the first groove 51, thus half of the quadrilateral prism is ground to have a semicircular cross section. In this way, each workpiece is ground to have a first portion and a second portion, the first portion is triangular and the second portion is semicircular whose bottom matches (i.e., is shaped so as to conform to) with the bottom of the first portion. The second portion is exposed through the first groove 51, and the first portion is engaged with the first groove 51.

After grinding the first side, the dried ultraviolet glue is dissolved by water or other kinds of solvent. The second base 60 covers the first base 50, the second portion of each workpiece is engaged with the second groove 61. The first base 50 and the second base 60 are turned together, the first base 50 is removed, and all the workpieces are transferred to the second groove 61 of the second base 60. In this way, the first portion of each workpiece is exposed through the second groove 61. The workpieces are secured in the second groove 61 in a similar way to that in which the workpieces are secured in the first groove 51 and thus form a column. The column includes a cylinder portion and a prism portion, the prism portion of the first prism is exposed through the second groove 61 and the cylinder portion is engaged with the second groove 61. The grinding wheel is used to grind the prism portion, thus the prism portion is also ground to have a semicircular portion. In this way, the column is ground to be a cylinder, and each workpiece is ground to have a round shape.

However, when the dried ultraviolet glue is dissolved for moving the workpieces from the first base 50 into the second base 60, a little ultraviolet glue is likely to remain on the first base 50, particularly in the first groove 51. Therefore, some workpieces are likely to remain attached to the first base 50 by remaining ultraviolet glue when the first base 50 is turned. Placing these workpieces into the second base 60 and adjusting each of the workpieces to sit in a proper position requires much additional work, thus efficiency of cylindrical grinding is decreased. Additionally, if the number of the workpieces placed into the first groove 51 is too large, the quadrilateral prism formed by the workpieces may be too long, and the quadrilateral prism may become distorted when it is ground or turned, and some workpieces may be damaged.

Therefore, a new fixture for grinding machines is desired in order to overcome the above-described shortcomings.

SUMMARY OF THE INVENTION

A fixture for grinding machines includes a first base, a second base and a driving component. The first base defines a first working groove therein. The second base defines a second working groove corresponding to the first working groove therein. The driving component is configured for sliding in the first working groove to remove workpieces from the first base, and sliding in the second working groove to cooperate with the second base to hold workpieces in the second working groove.

Other novel features will become more apparent from the following detailed description when taken in conjunction with the accompanying drawings.

BRIEF DESCRIPTION OF THE DRAWINGS

Many aspects of the fixture can be better understood with reference to the following drawings. The components in the drawings are not necessarily drawn to scale, the emphasis instead being placed upon clearly illustrating the principles of the present fixture. Moreover, in the drawings, like reference numerals designate corresponding parts throughout the several views.

DETAILED DESCRIPTION OF THE INVENTION

Figure 1:
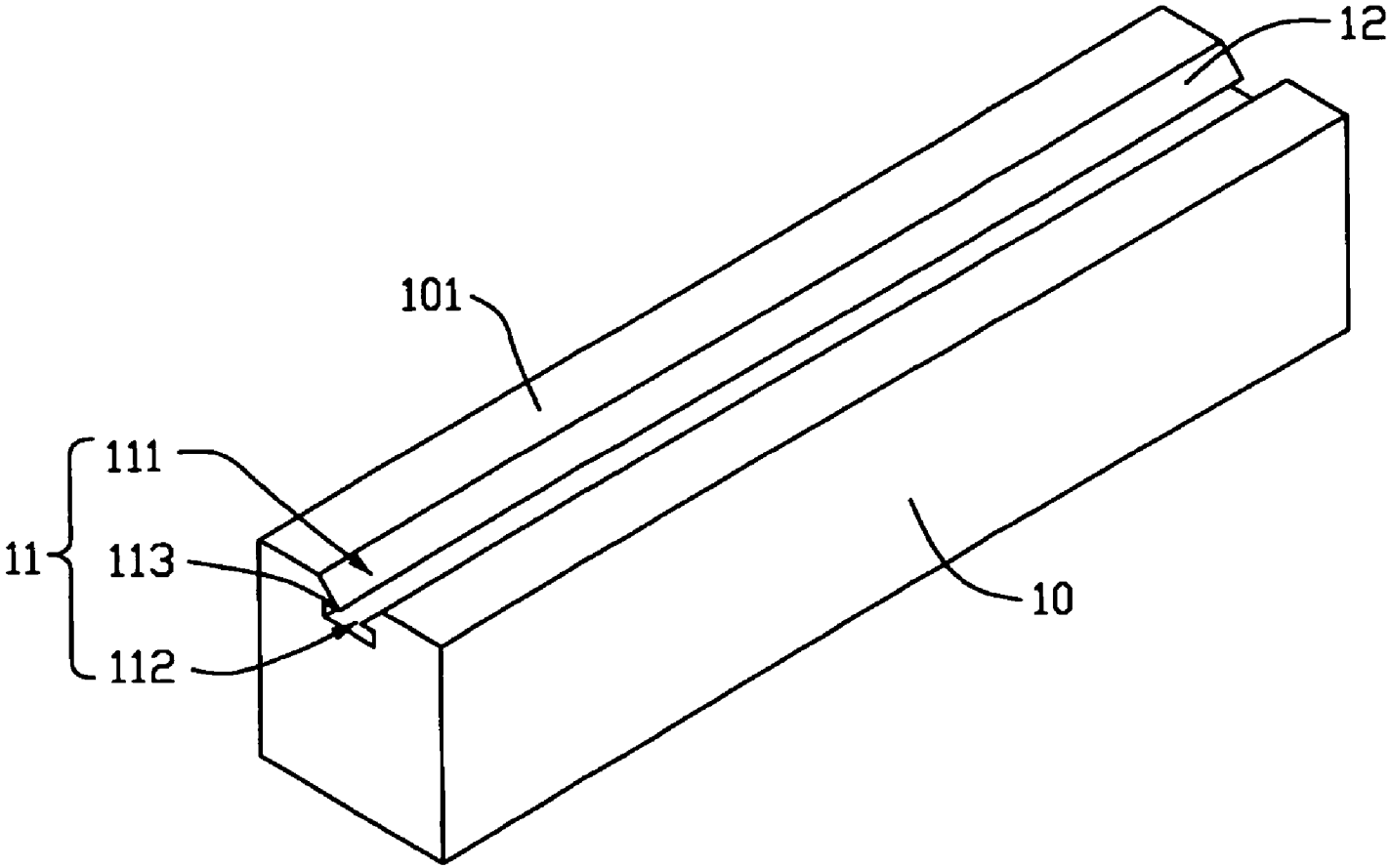
FIG. 1 is an isometric view of a first base of a fixture in accordance with a preferred embodiment of the present invention.

Referring now to the drawings in detail, FIG. 1, FIG. 2, FIG. 3 and FIG. 4 show all components of a fixture for grinding machines in accordance with a preferred embodiment of the present invention. The fixture includes a first base 10, a second base 20, a plurality of partitions 30 and a driving component 40. The fixture can be used to grind workpieces, such as, for example, round lenses.

Referring now to FIG. 1, the first base 10 is substantially cuboid. The first base 10 includes a first working surface 101 and defines a first working groove 11 on the first working surface 101. The first working groove 11 runs through the first base 10. The first working groove 11 defines a grinding groove 111 and a cleaning groove 112 in communication with the grinding groove 111. The grinding groove 111 has a trapeziform cross section, the cleaning groove 112 has a rectangular cross section, and the grinding groove 111 is parallel to the cleaning groove 112. A width of the grinding groove 111 at its join with the cleaning groove 112 is less than a width of the cleaning groove 112, thus two sliding rails 113 are formed beside the first working groove 11. Two inclined planes 12 positioned corresponding to the grinding groove 111 are formed in the first base 10, the two inclined planes 12 form an angle of 90 degrees. Additionally, a plurality of grooves similar to the first working groove 11 can be defined on the first working surface 101. Angle formed by the two inclined planes 12 can be changed to correspond with the workpieces.

Figure 2:
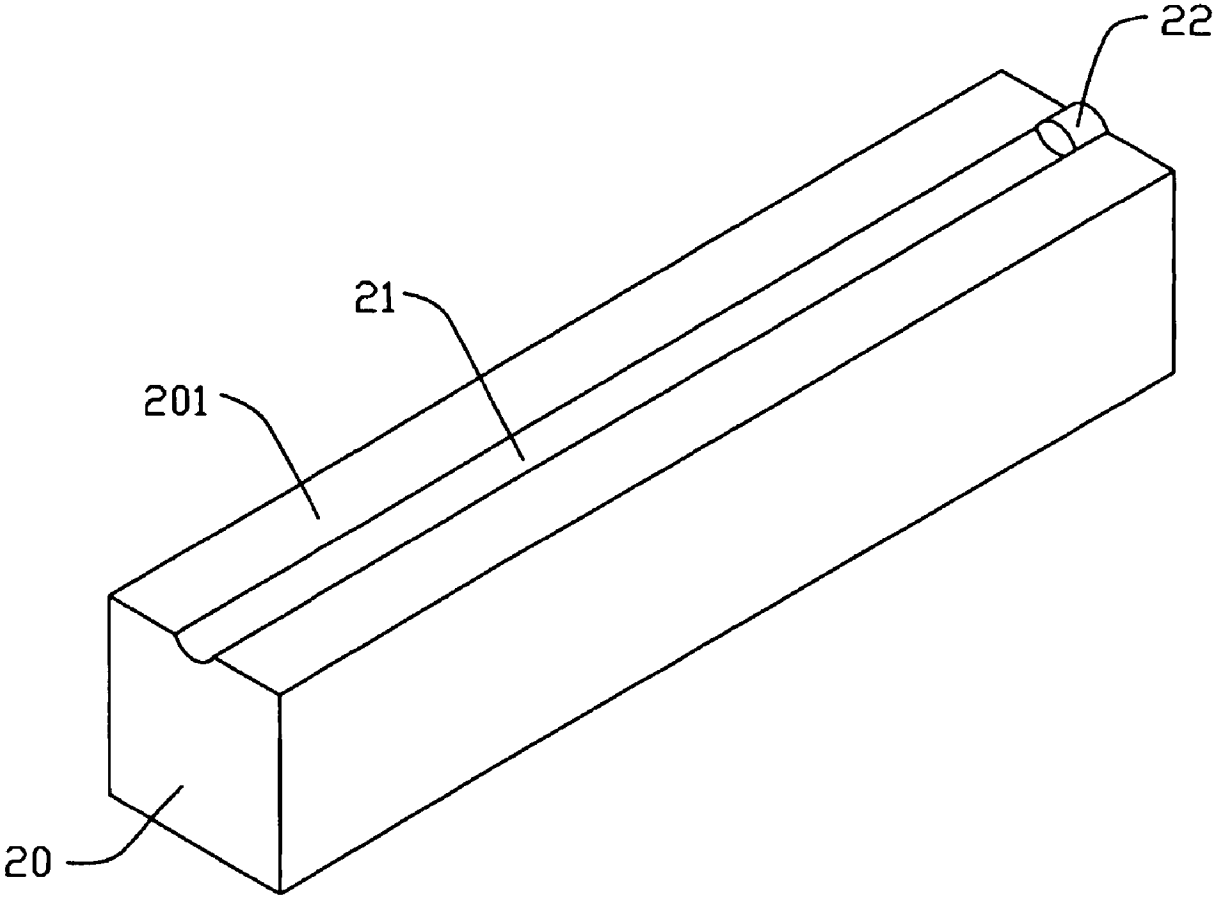
FIG. 2 is an isometric view of a second base of the fixture in accordance with the preferred embodiment of the present invention.

Referring to FIG. 2, the second base 20 is also substantially cuboid. The second base 20 includes a second working surface 201 and defines a second working groove 21 corresponding to the first working groove 11 on the second working surface 201. The second working groove 21 has a semicircular cross section, a diameter of the semicircular cross section being equal to a diameter of ground workpieces. One end of the second working groove 21 runs through the second base 20, a confining block 22 is formed on the second working surface 201, the confining block 22 blocks another end of the second working groove 21, and size of the confining block 22 is less than a diameter of ground workpieces. Additionally, a plurality of grooves similar to the second working groove 21 can be defined on the second working surface 201 to correspond with the grooves defined on the first working surface 101.

Figure 3:
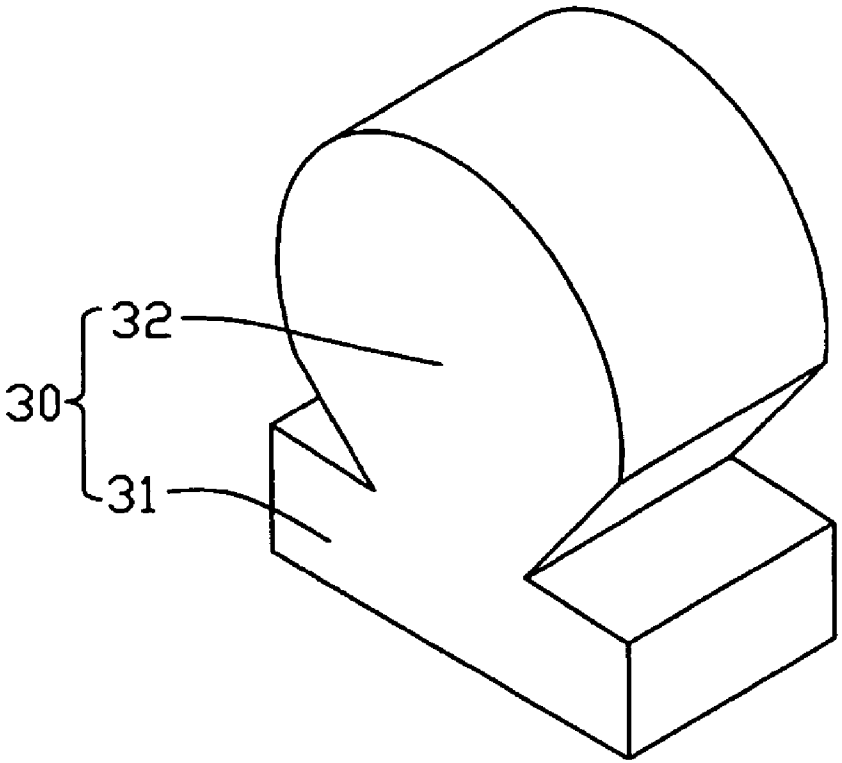
FIG. 3 is an enlarged isometric view of one of partitions of the fixture in accordance with the preferred embodiment of the present invention.

Referring to FIG. 3, the partitions 30 are sliding components that can slide in the first working groove 11. The partitions 30 are made of elastic material such as rubber for preventing adjacent workpieces from being damaged. Each partition 30 includes a sliding portion 31 and an extending portion 32. The cross section of the sliding portion 31 coincides with the cross section of the first working groove 11. The extending portion 32 connects with the sliding portion 31, and size of the extending portion 32 is less than a diameter of ground workpieces.

Figure 4:
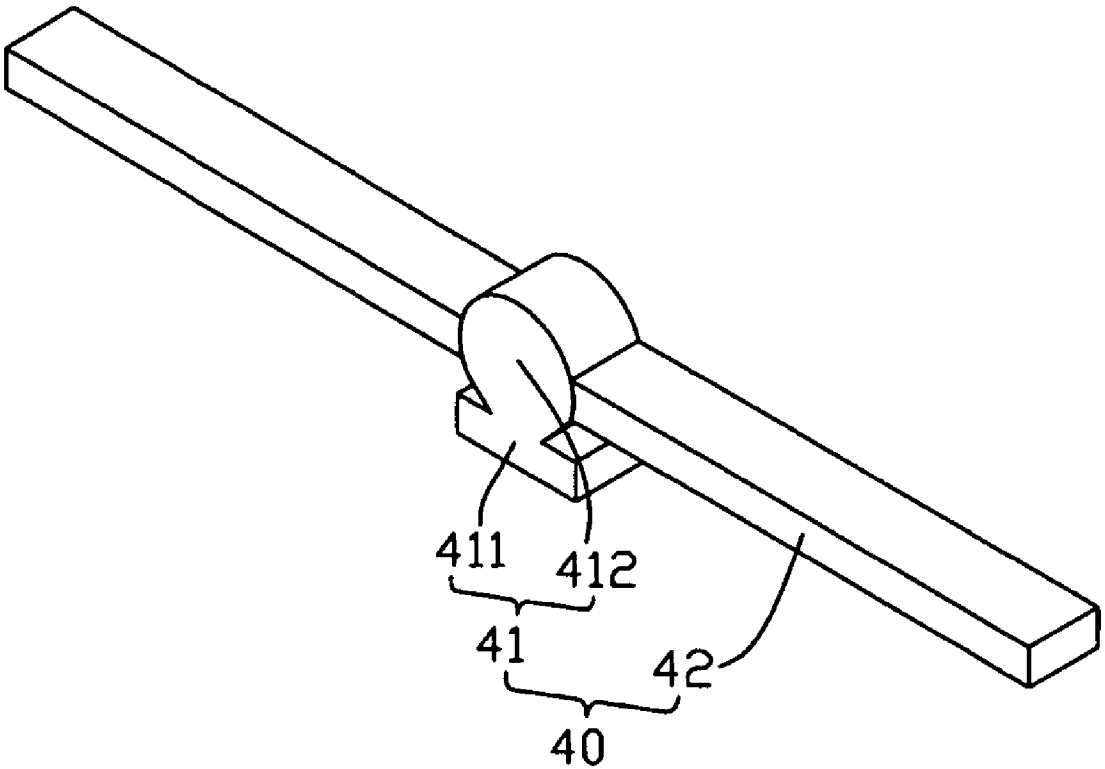
FIG. 4 is an enlarged isometric view of a driving component of the fixture in accordance with the preferred embodiment of the present invention.

Referring to FIG. 4, the driving component 40 includes a pushing board 41 and two driving poles 42. The pushing board 41 is made of elastic material such as rubber for preventing adjacent workpieces from being damaged. Shape of the pushing board 41 is similar to the partitions 30, and the pushing board 41 includes a sliding board 411 and an extending board 412. The shape of the sliding board 411 coincides with the cross section of the first working groove 11. The extending board 412 connects with the sliding board 411, and size of the extending board 412 is less than diameter of ground workpieces. The two driving poles 42 each connects with their respective sides of the extending board 412.

Figure 5:
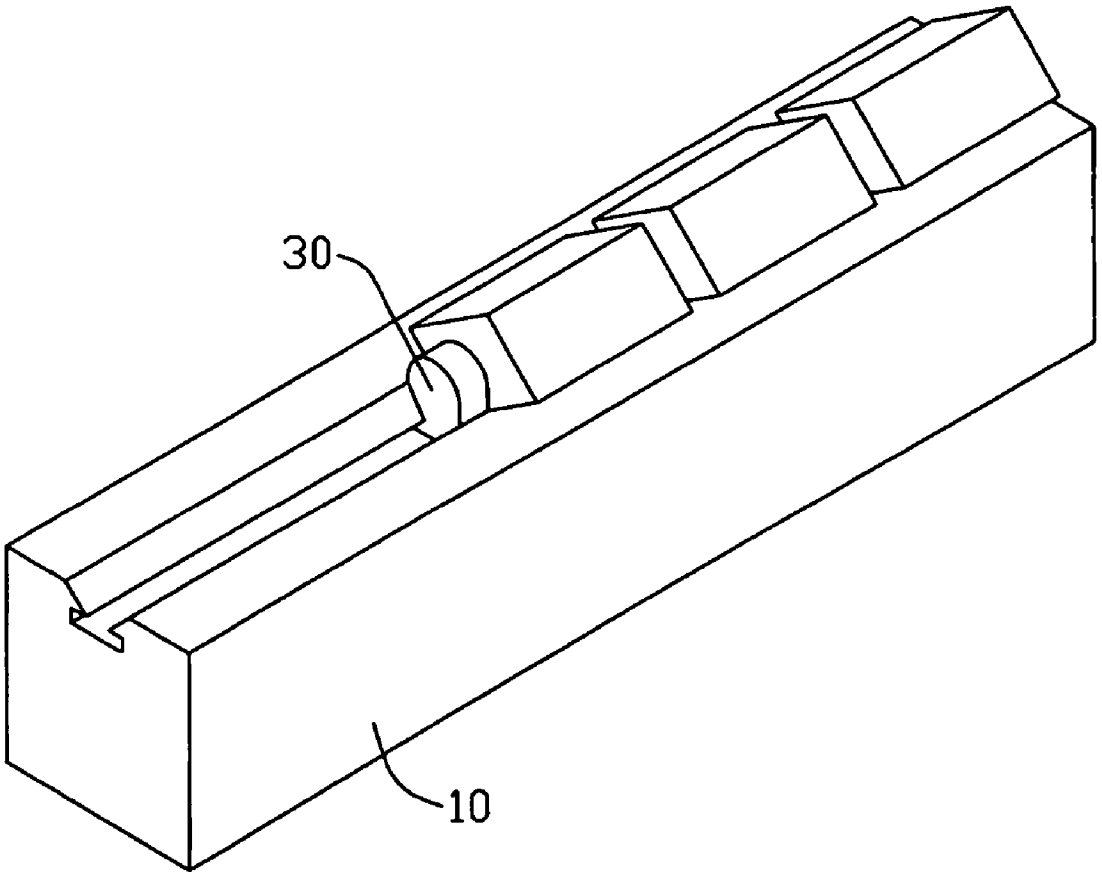
FIG. 5 is an isometric view of workpieces that need to be ground and are placed in the first base of the fixture.
Figure 6:
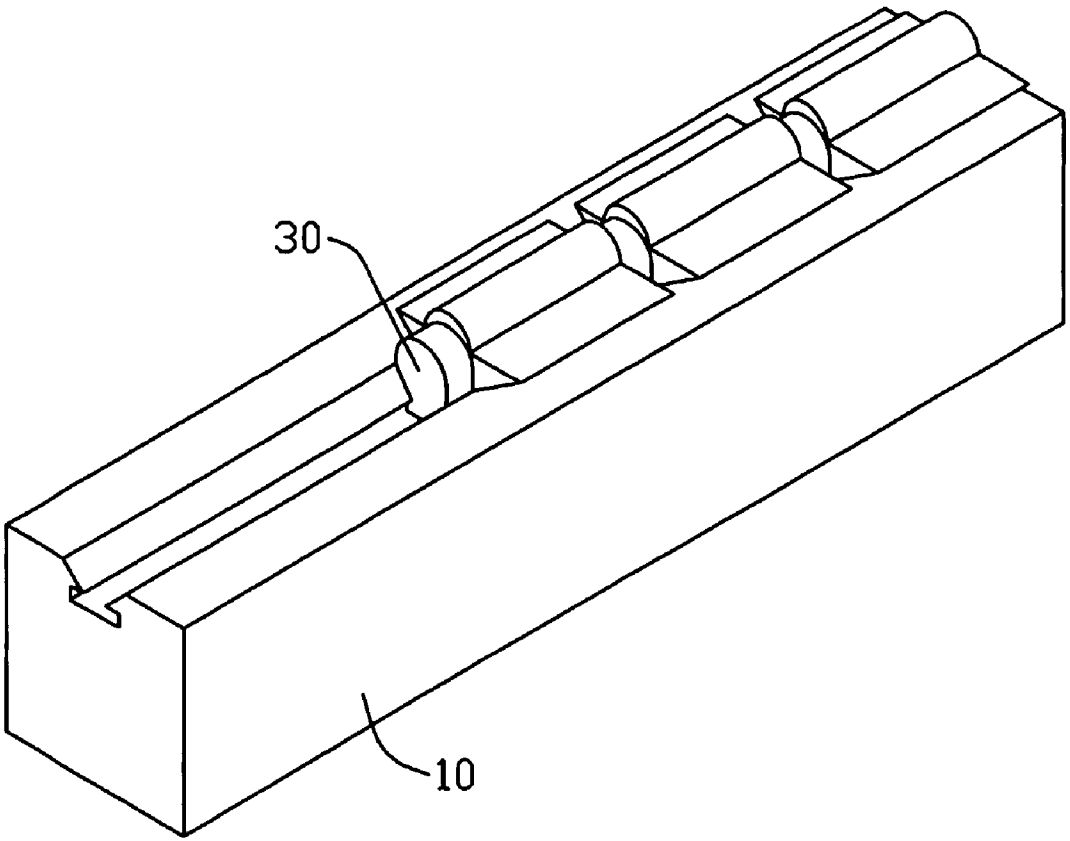
FIG. 6 is an isometric view of the workpieces that have been ground in part and are placed in the first base of the fixture.

In FIG. 5 and FIG. 6 the fixture in accordance with the preferred embodiment of the present invention is shown. A material such as glass (not shown) is cut to form a plurality of rectangular workpieces (not shown), the workpieces are then placed in the grinding groove 111 of the first working groove 11. Two adjacent sides of each workpiece are engaged with the two inclined planes 12 of the first base 10, each workpiece is aligned with all other workpieces and pressed close to other workpieces adjacent to itself. After a proper quantity of workpieces are placed into the grinding groove 111 of the first working groove 11, a partition 30 is aligned with one end of the first working groove 11 and the two sliding rails 13 are engaged with the partition 30. The partition 30 is pushed to slide along the first working groove and pressed against the workpieces. After the partition is properly positioned, some other workpieces are placed in the grinding groove 111, and another partition 30 is pushed into the first working groove 11. In this way, workpieces and partitions 30 are placed in the first working groove 11 in turn until the first working groove 11 is filled, and the workpieces in the first working groove 11 are separated into a plurality of groups by the partitions 30.

Ultraviolet glue is applied to the workpieces. The ultraviolet glue dries after being irradiated by ultraviolet radiation, thus all workpieces are secured in the first base 10, and each group of workpieces forms a quadrilateral prism (not labeled), the partitions 30 separate each quadrilateral prism from the other quadrilateral prisms. Alternatively, the quadrilateral prisms formed by glued workpieces can be formed one by one. Two side faces of each quadrilateral prism are exposed through the first working groove 11 and the other two side faces of each quadrilateral prism are engaged with the first working groove 11. In this way, the ultraviolet glue prevents the workpieces from moving when the workpieces are being ground.

A grinding machine (not shown) with a grinding wheel (not shown) is provided to grind the two side faces exposed through the first working groove 11, thus half of each quadrilateral prism is ground to have a semicircular cross section. Because size of the extending portion 32 of each partition 30 is less than diameter of ground workpieces, the partitions 30 do not obstruct the grinding wheel while the grinding wheel is grinding the workpieces. In this way, each workpiece is ground to have a first portion and a second portion, the first portion is triangular and the second portion is semicircular with a bottom that conforms to the bottom of the first portion. The second portion is exposed through the first working groove 11, and the first portion is engaged with the first working groove 11.

Figure 7:
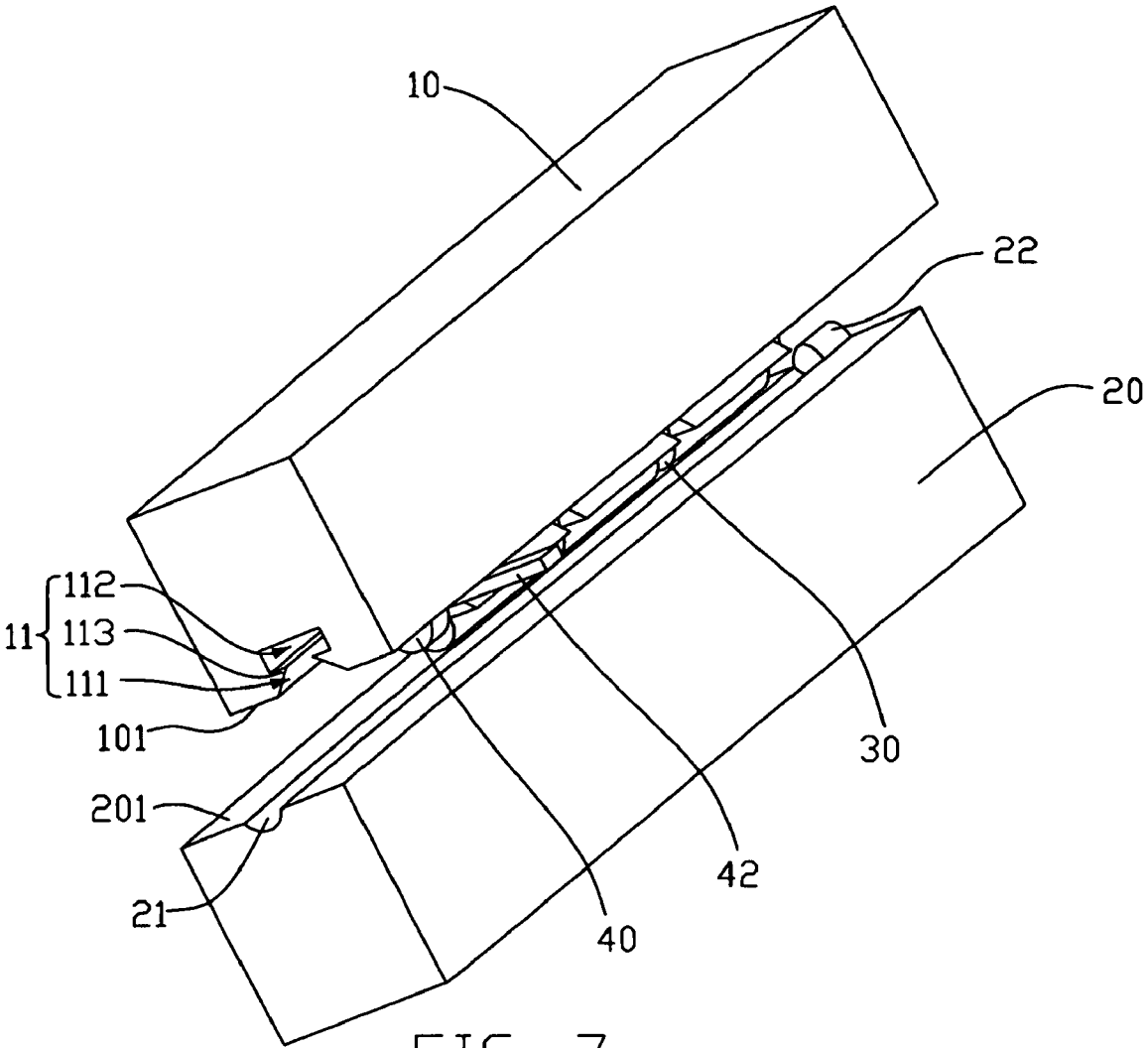
FIG. 7 is an isometric view of turning the fixture.
Figure 8:
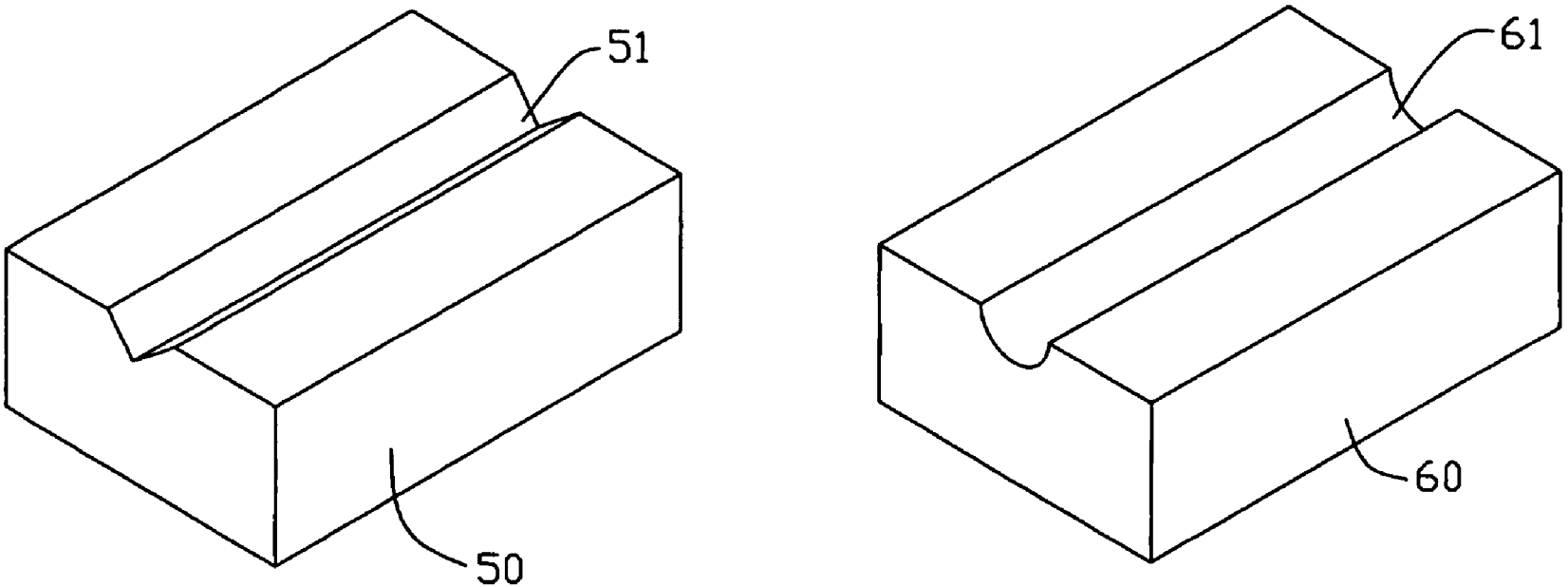
FIG. 8 (RELATED ART)
FIG. 8 is an isometric view of a typical fixture for grinding machines.

Also referring to FIG. 7, after each workpiece is ground in part, water or other kinds of solvents are applied to the workpieces to dissolve the dried ultraviolet glue, then the workpieces are released from the first base 10. The solvent dissolving the ultraviolet glue is allowed to flow out of the first base 10 along the cleaning groove 112 in communication with the grinding groove 111 for removing remaining ultraviolet glue. The second base 20 then covers the first base 10, the confining block 22 blocks one end of the first working groove 11 and prevents the workpieces from being pushed out of the first base 10, and the second portion of each workpiece is engaged with the second working groove 21. The pushing board 41 of the driving component 40 is aligned with another end that is located opposite to the confining block 22 of the first working groove 11, and the driving component 40 is pushed into the first working groove 11. The driving poles 42 are pushed towards the confining block 22, and the pushing board 41 is also pushed to slide along the sliding rails 113 to the confining block 22. In this way, some workpieces that remain attached to the first base 10 by the remaining ultraviolet glue are separated from the first base 10 by the sliding pushing board 41.

The first base 10 and the second base 20 are turned together. The first base 10 is taken away and all workpieces are received in the second working groove 21. The partitions 30 and the driving component 40 are taken away with the first base 10 due to the sliding portion 31 of each partition 30 and the sliding board 411 of the component 40 engaging with the cleaning groove 112 and being held by the sliding rails 113.

The driving component 40 is taken away from the first base 10 and the extending board 412 of the pushing board 41 is pushed into the second working groove 21. The driving poles 42 are pushed towards the confining block 22, and the pushing board 41 is also pushed to slide towards the confining block 22, thus all workpieces are pressed against the confining block 22. The workpieces are adjusted to be placed in the second working groove 21 perpendicularly, ultraviolet glue is applied to the workpieces and irradiated with ultraviolet radiation, thus all workpieces are secured in the second working groove 21 and form a column (not labeled). The column includes a cylinder portion and a prism portion, the prism portion of the first prism is exposed through the second working groove 21 and the cylinder portion is engaged with the second working groove 21. The grinding wheel is used to grind the prism portion, thus the prism portion is also ground to have a semicircular portion. Because size of the confining block 22 is less than diameter of ground workpieces, confining block 22 does not obstruct the grinding wheel in grinding the workpieces. In this way, the column is ground to be a cylinder, and thus each workpiece is ground to have a round shape. After the workpieces are ground, the ultraviolet glue is dissolved, the workpieces are released and can then be taken away from the second base 20.

It should be understood that when the workpieces are separated by the partitions 30 to form short prisms, the short prisms are less prone to distortion during grinding or turning. Additionally, if the number of workpieces is small, all workpieces can be glued to be a prism without being separated.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fixture for grinding machines, comprising:

a first base defining a first working groove configured for receiving and holding a first portion of a workpiece therein;

a second base defining a second working groove corresponding to the first working groove and configured for receiving and holding a second portion of the workpiece therein, and a driving component configured for sliding in the first working groove to remove the workpiece from the first base, and configured for sliding in the second working groove and cooperating with the second base to hold the workpiece in the second working groove.

2. The fixture as claimed in claim 1, wherein the first working groove includes a grinding groove and a cleaning groove which is parallel to and in communication with the grinding groove.

3. The fixture as claimed in claim 2, wherein the grinding groove has a trapeziform cross section and tile cleaning groove has a rectangular cross section, a width of the grinding groove at its join with the cleaning groove being less than a width of the cleaning groove, thus forming two sliding rails beside the first working groove.

4. The fixture as claimed in claim 1, wherein the second working groove has a semicircular cross section, and a diameter of the semicircular cross section is equal to a diameter of ground workpieces.

5. The fixture as claimed in claim 4, wherein the second base includes a confining block formed thereon and blocking an end of the second working groove, and another end of the second working groove runs through the second base.

6. The fixture as claimed in claim 1, wherein the first base defines a plurality of grooves similar to the first working groove therein.

7. The fixture as claimed in claim 6, wherein the second base defines a plurality of grooves similar to the second working groove corresponding with the grooves defined on the first base.

8. The fixture as claimed in claim 1, wherein the fixture includes a plurality of partitions configured for separating a plurality of workpieces into a plurality of groups, each partition being slidably received in the first working groove.

9. The fixture as claimed in claim 8, wherein each partition includes a sliding portion configured for sliding in the first working groove and an extending portion connected to the sliding portion.

10. The fixture as claimed in claim 1, wherein the driving component includes a pushing board which comprising a sliding board configured for sliding in the first working groove to remove workpieces front the first base, and an extending board connecting with the sliding board.

11. The fixture as claimed in claim 10, wherein the driving component includes two driving poles configured for operating the driving component, the two driving poles being connected to two opposite sides of the extending board respectively.

12. A fixture for grinding machines configured for grinding a plurality of workpieces, comprising:

a first base defining at least one first working groove therein;

a second base defining at least one second working groove corresponding to the first working groove therein;

a plurality of partitions slidably held in the first working groove and configured for separating the plurality of workpieces to be a plurality of groups; and a driving component that includes a pushing board the pushing board comprising a sliding board configured for sliding in the first working groove to remove workpieces from the first base, and an extending board connecting with the sliding board and configured for sliding in the second working groove and cooperating with the second base to hold workpieces in the second working groove.

13. The fixture as claimed in claim 12, wherein the first working groove includes a grinding groove and a cleaning groove which is parallel to and in communication with the grinding groove.

14. The fixture as claimed in claim 13, wherein the grinding groove has a trapeziform cross section and the cleaning groove has a rectangular cross section, a width of the grinding groove at its join with the cleaning groove being less than a width of the cleaning groove, thus forming two sliding rails beside the first working groove.

15. The fixture as claimed in claim 12, wherein the second working groove has a semicircular cross section, and a diameter of the semicircular cross section is equal to a diameter of ground workpieces.

16. The fixture as claimed in claim 15, wherein the second base includes a confining block formed thereon and blocking an end of the second working groove, and another end of the second working groove runs through the second base.

17. The fixture as claimed in claim 12, wherein each partition includes a sliding portion configured for sliding in the first working groove and an extending portion connected to the sliding portion.

18. The fixture as claimed in claim 12, wherein the driving component includes two driving poles configured for operating the driving component, the two driving poles being connected to two opposite sides of the extending board respectively.

* * * * *